US005722536A

United States Patent [19]

Pierce et al.

[11] Patent Number: 5,722,536

[45] Date of Patent: Mar. 3, 1998

[54] DISPOSABLE CONTACT LENS PACKAGE WITH SNAP-TOGETHER FEATURE

[75] Inventors: Joan L. Pierce, Honeoye Falls; Margaret Mary R. Godly, Farmington; Steven B. Renner, Rochester, all of N.Y.

[73] Assignee: Bausch & Lomb Incorporated, Rochester, N.Y.

[21] Appl. No.: 598,303

[22] Filed: Feb. 8, 1996

[51] Int. Cl.[6] ..... A45C 11/04

[52] U.S. Cl. ..... 206/5.1; 206/205; 206/461; 220/326

[58] Field of Search ..... 206/5.1, 205, 5 R, 206/461, 467, 471, 484; 220/326, 306; 134/901

[56] References Cited

U.S. PATENT DOCUMENTS

| | | | |
|---|---|---|---|
| 3,645,284 | 2/1972 | Krezanoski . | |
| 3,804,236 | 4/1974 | Tanaka . | |
| 4,691,820 | 9/1987 | Martinez . | |
| 5,054,610 | 10/1991 | Ajello . | |
| 5,069,494 | 12/1991 | Reinson . | |
| 5,224,593 | 7/1993 | Bennett . | |
| 5,281,227 | 1/1994 | Sussman | 206/5.1 |
| 5,375,698 | 12/1994 | Ewart . | |
| 5,433,314 | 7/1995 | Lin . | |
| 5,467,868 | 11/1995 | Abrams . | |
| 5,474,169 | 12/1995 | Bauman . | |
| 5,515,964 | 5/1996 | Bauman | 206/5.1 |

FOREIGN PATENT DOCUMENTS

| | | | |
|---|---|---|---|
| 0223581A2 | 5/1987 | European Pat. Off. . | |
| 269367 | 6/1988 | European Pat. Off. | 206/5.1 |
| 530055 | 3/1993 | European Pat. Off. | 206/5.1 |
| 0604177A2 | 6/1994 | European Pat. Off. . | |
| 0650676A1 | 5/1995 | European Pat. Off. . | |
| 0680895A1 | 11/1995 | European Pat. Off. . | |
| 9219123 | 11/1992 | WIPO | 206/5.1 |

*Primary Examiner*—Paul T. Sewell
*Assistant Examiner*—Luan K. Bul
*Attorney, Agent, or Firm*—Katherine McGuire

[57] ABSTRACT

A disposable contact lens package includes a plurality of legs extending from the periphery thereof which may be placed in releasable, meshing engagement with the legs of a second identical package placed in stacked relation to the first package, the two stacked packages forming a compact unit thereby facilitating shipping, storage, and subsequent handling by the consumer.

29 Claims, 6 Drawing Sheets

FIG. 4
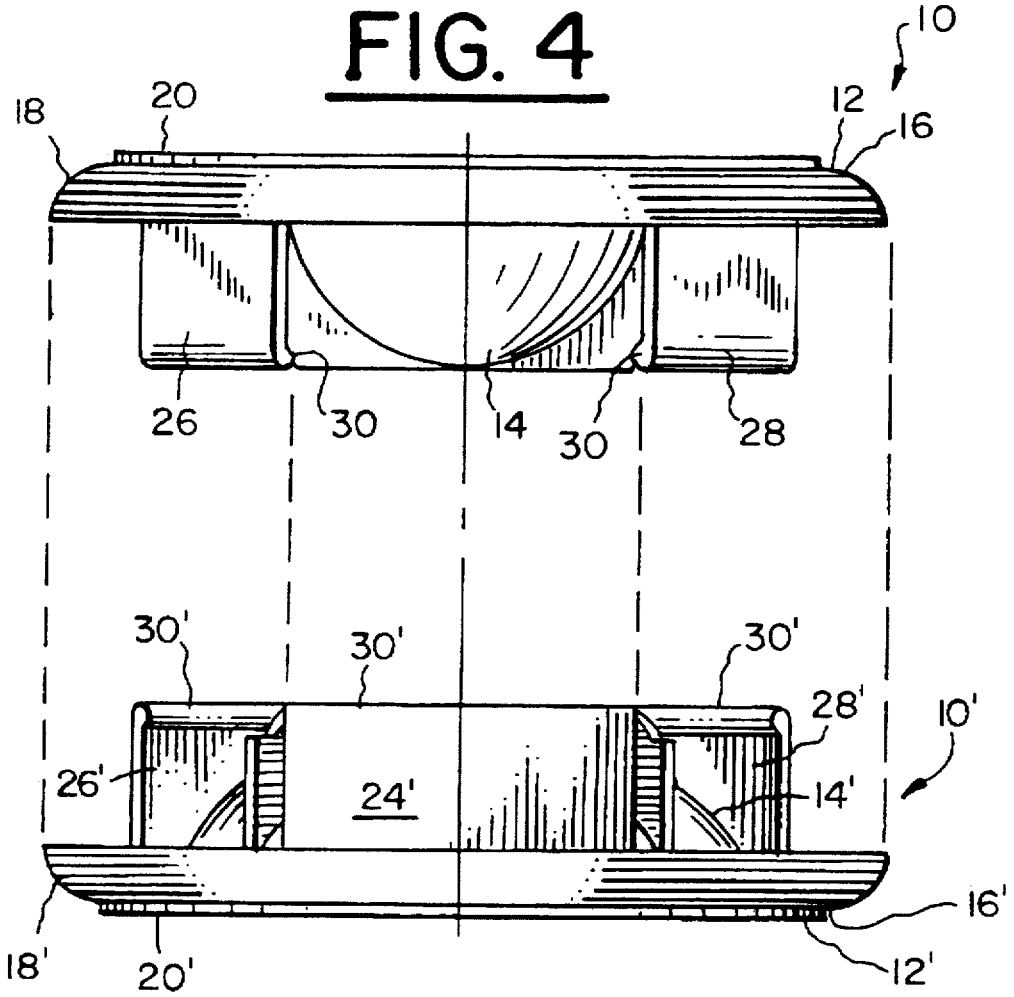
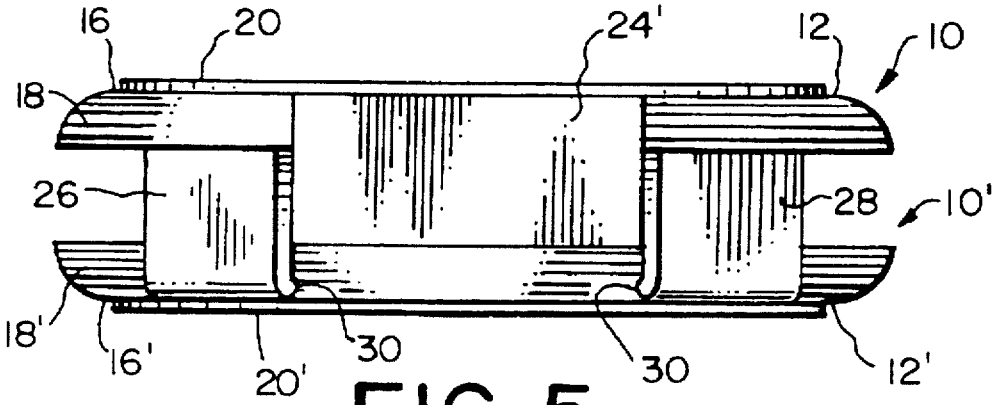
FIG. 5

DISPOSABLE CONTACT LENS PACKAGE WITH SNAP-TOGETHER FEATURE

BACKGROUND OF THE INVENTION

The present invention relates to contact lens packages, and more particularly relates to disposable contact lens packages having features which permit two such packages (e.g., one holding a right lens and one holding a left lens of a lens pair) to be releasably secured together in a very compact manner for efficient handling and carrying by the consumer.

Soft contact lenses have been increasing in popularity ever since they were first introduced in the 1970's. Improved manufacturing methods have led to reduced manufacturing costs to the point where disposable contact lenses are an economically viable and attractive alternative for the consumer. This, coupled with very strong competition in the contact lens market, creates the need for innovative, inexpensive, and easy to use disposable packages in which soft contact lenses may be individually packaged, safely shipped and stored until ready to use by the consumer, at which time the contact lens is removed from the package which is then discarded.

Contact lenses are very small, delicate articles which must be handled with great care from the time they are manufactured to the time they are used and ultimately discarded. Once manufactured, they are inspected and packaged for shipping to the consumer, usually in the hydrated state. A popular contact lens package which is especially designed for packaging single contact lenses is the so-called "blister-pack" which generally comprises a molded, rigid, plastic container having a planar top surface with a concave-shaped well formed therein and wherein a single contact lens is placed with a quantity of storage fluid. A flexible cover is sealed about the perimeter of the top surface of the top surface of the container whereupon the blister packs are boxed and shipped to the consumer who peels back the flexible cover to retrieve the lens. An example of a disposable contact lens blister-package may be seen in Des. 299,085 assigned to Vistakon, Inc. on Dec. 27, 1988.

Contact lenses which are frequently replaced by the consumer (e.g., daily, weekly) have become very popular since they do not need to be cleaned and sterilized as often as contact lenses used in a traditional wearing regime. Consumers of frequent replacement lenses of course need to maintain a larger supply of lenses on hand than do consumers of contact lenses using a traditional wearing regime. It is thus desirable to maintain as small a package as possible while making it easy for the consumer to open the package and retrieve the lens, while also having a package wherein a plurality of such packages may be easily and unobtrusively carried by the consumer (e.g., in a pocket, purse or suitcase). Efficient shipping and subsequent handling of a plurality of disposable contact lens packages by the consumer are thus very important packaging design criteria, especially for frequent replacement lenses.

SUMMARY OF THE INVENTION

The present invention comprises a disposable package for a single contact lens, the package including features permitting two substantially identical packages (e.g., one for a right lens and one for a left lens) to be releasably secured together for ease of shipping, storage, and subsequent handling by the consumer. The package basically comprises a rigid, molded, plastic support having a planar top surface with a lens-seating surface formed therein for placement of a contact lens thereon with a quantity of storage fluid. A flexible cover (e.g., foil) is then sealed to the top surface about the lens-seating surface which hermetically seals the lens in the package. The consumer peels away the cover to retrieve the lens from the lens-seating surface when needed, and thereafter discards the package. In a preferred embodiment, the plastic support is elliptically shaped and the lens-seating surface is a concave well located in a position off-set from the center of the support.

The package comprises means for releasably securing two such packages together. In the preferred embodiment shown and described herein, the releasable securing means comprises a plurality of legs which are integrally molded with the plastic support, depending downwardly from locations about the perimeter of the support in the same direction as the well. Two packages are placed together in a stacked relationship with the bottoms of the packages facing one another and the wells lying in side-by-side relation (i.e., one package is turned 180° relative to the other package). The legs on each support are spaced to mesh with one another as the packages as brought together. In the preferred embodiment, at least some of the legs include small catches at the free ends thereof which releasably engage the perimeter of the support of the opposite package. As such, the consumer may conveniently and efficiently carry a pair of contact lenses together (i.e., one prescription), one in each package.

BRIEF DESCRIPTION OF THE DRAWINGS

FIG. 4 is an end view of FIG. 3;

FIG. 5 is an end view of FIG. 1;

DETAILED DESCRIPTION

Figure 6:
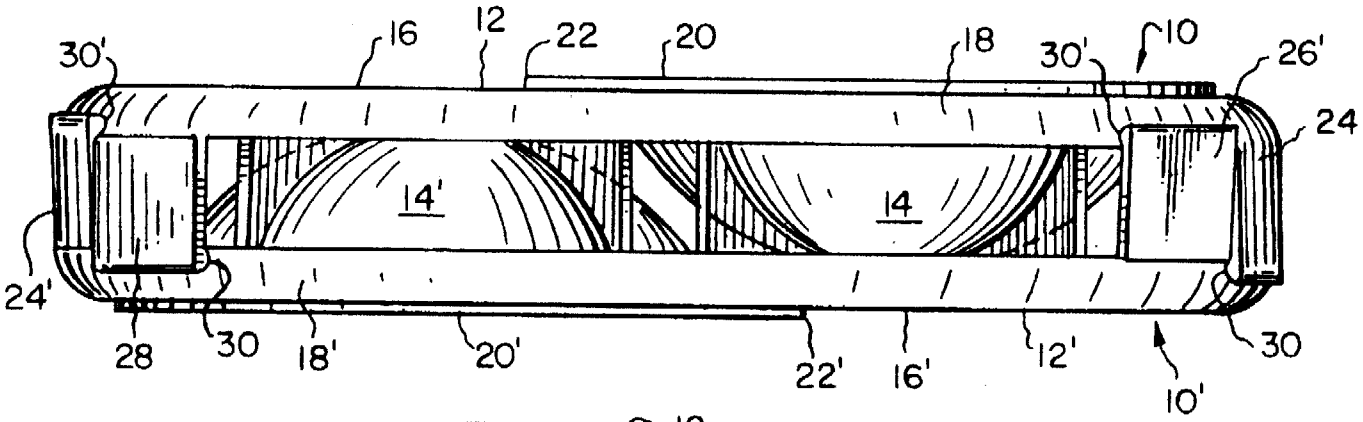
FIG. 6 is a side, elevational view of FIG. 1.
Figure 1:
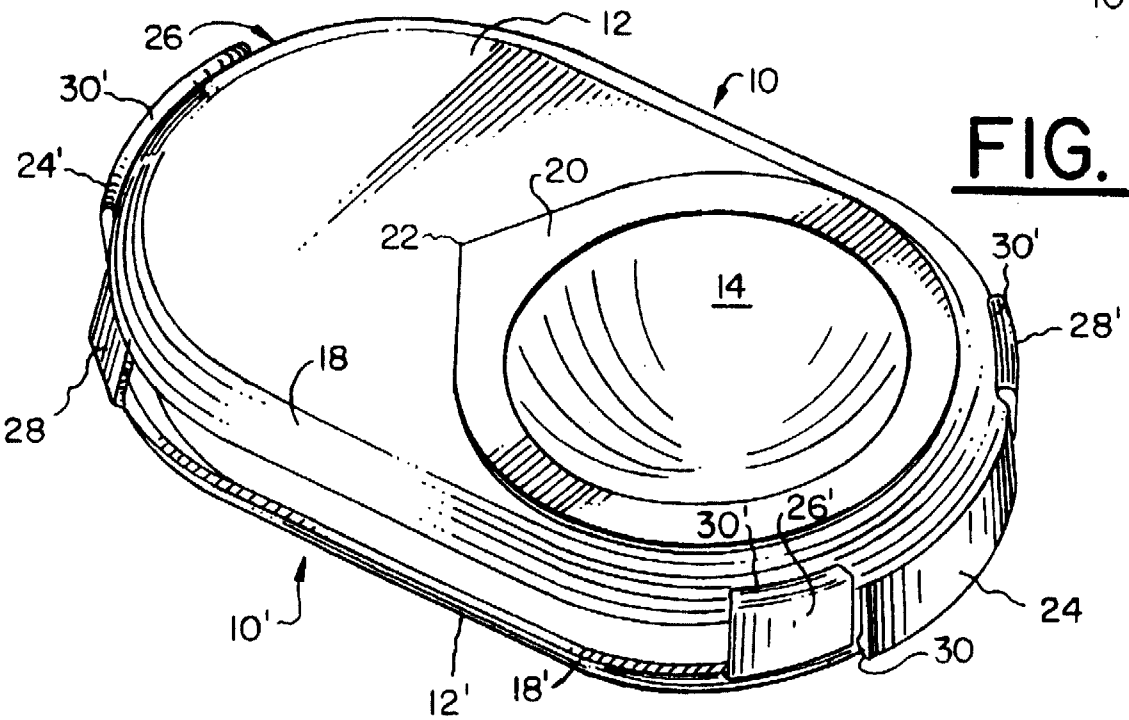
FIG. 1 is a perspective view of a pair of a first embodiment of the inventive contact lens packages releasably attached together in the intended manner.
Figure 2:
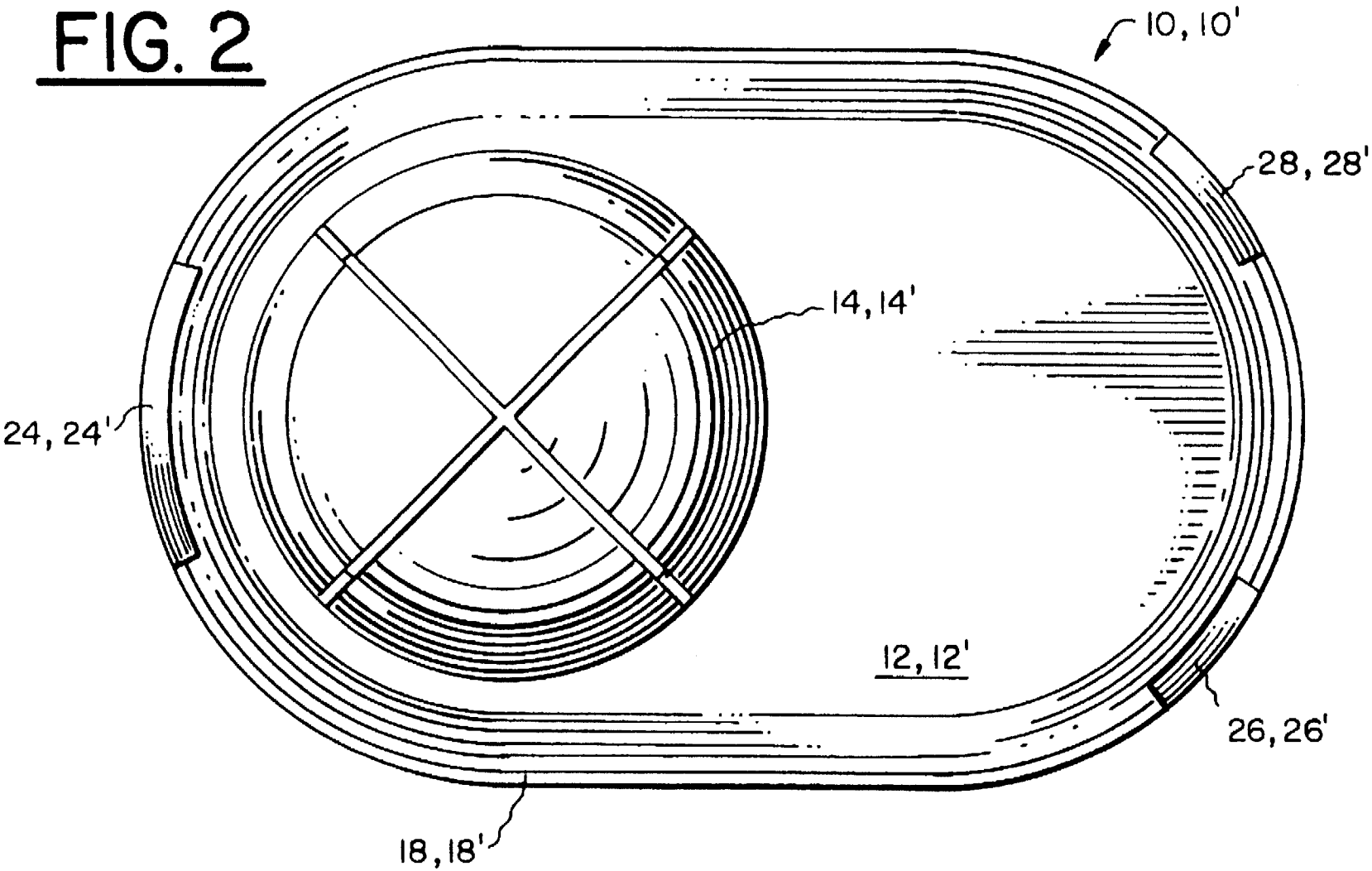
FIG. 2 is a bottom plan view of a single package shown in FIG. 1.

Referring now to the drawing, there is seen in FIGS. 1–6 a first embodiment of the disposable contact lens package 10 which may be releasably attached to a substantially identical package 10'. It is noted primed numerals are used to designate the same elements of the second package 10' in these Figures and, since the packages 10, 10' are substantially identical, both numerals are used to designate the single package seen in FIG. 2. In use, it is intended the two packages 10, 10' contain a pair (left and right) of a contact lens prescription, respectively.

Package 10,10' generally comprises a rigid support 12,12' which may be molded (e.g., from polypropylene) in the elliptical shape shown with a concave recess or well 14,14' off-set from the center of support 12,12' and wherein a contact lens (not shown) may be placed with a quantity of storage fluid. It is noted shapes other than elliptical may be chosen for support 12,12' as desired. Also, it is preferred well 14,14' be of approximately the same diameter as the contact lens being placed therein to enable easy retrievability by the consumer.

Figure 3:
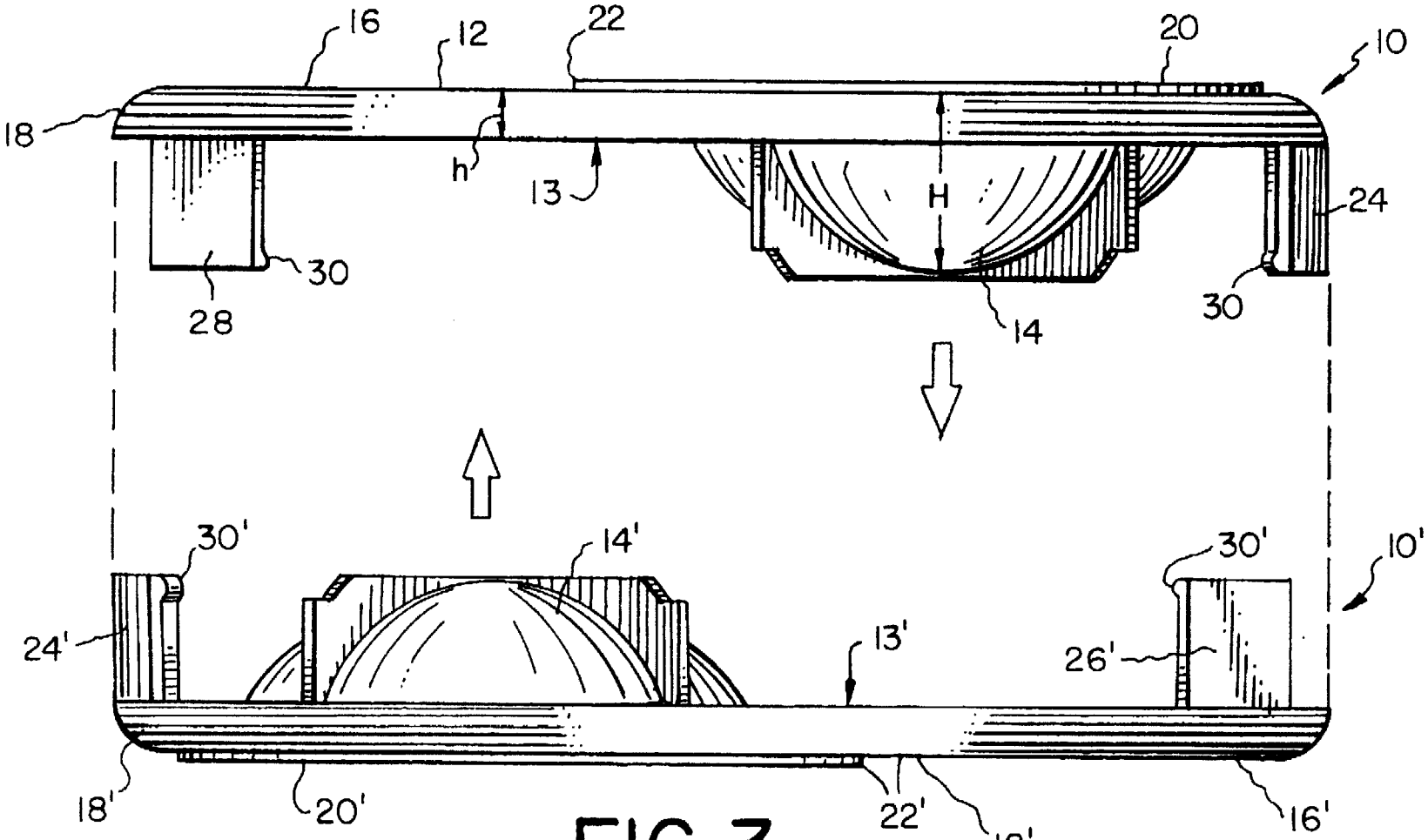
FIG. 3 is a side, elevational view of the two packages of FIG. 1 shown in spaced relation prior to being attached together.

Support 12,12' includes a substantially planar top surface 16,16' surrounding well 14,14', and further includes a softly curved perimeter forming a skirt 18,18' depending downwardly (in the same direction as well 14,14') about the full periphery of surface 16,16'. In the preferred embodiment, skirt 18,18' has a height "h" which is approximately half, and more preferably less than half, of the height "H" of well 14,14' (FIG. 3). It is noted top surface 16,16' is provided with a tear-shaped, raised surface 20,20' encircling the periphery of well 14,14', and including a pointed portion 22,22' facing in the direction of top surface 16,16'. Once a manufactured and inspected lens has been deposited in well 14,14' with a quantity of storage fluid, a flexible cover (e.g., foil, not shown) is sealed (e.g., by heat-sealing) to raised surface 20,20', covering substantially the entire top surface 16,16' and hermetically sealing the lens in the package 10,10'. As the consumer peels back the cover to retrieve the lens (usually starting from the end of support 12,12' opposite well 14,14'), pointed portion 22,22' assists in breaking the seal of the cover to the raised portion 20,20'. As such, the consumer does not need to use as much force to remove the cover as in prior art designs which reportedly contributes to accidental spillage of the storage fluid contained in the well.

Support 12,12' further includes three spaced, integrally formed legs 24,24', 26,26', and 28,28', with one leg 24,24' being located at one end of support 12,12' adjacent well 14,14', and the other two legs 26,26' and 28,28' being located at the other end of support 12,12' in spaced relation to each other. In the preferred embodiment, each of the legs 24,24', 26,26' and 28,28' include small, inwardly turned catches 30,30' at the terminal ends thereof which frictionally engage with the skirt 18,18' of the opposite package when the two packages 10,10' are releasably secured together in the manner described below.

To releasably secure two packages 10,10' together, the bottom surfaces 13,13' thereof are positioned facing each other and one package 10 is turned 180° relative to the other package such that wells 14,14' lie in side-by-side relation to one another (FIGS. 3 and 6). The aforementioned spacing of the legs is such that the single leg 24,24' adjacent well 14,14' of one package extends between the two adjacent legs 26,26 and 28,28' of the opposite package, and vice-versa. The legs 24,24',26,26', and 28,28' are preferably resiliently flexible such that they may move slightly relative to surface 12,12'. As such, legs 24,24', 26,26' and 28,28' will move slightly when the two packages are pressed together until the catches 30,30' thereof frictionally engage the skirt 18,18' of the opposite package. The frictional engagement between the catches 30,30' and skirt 18,18' is such so as to prevent packages 10,10' from separating from each other during normal handling, yet allow easy separation upon manually pulling the packages 10,10' away from each other. When attached together in this manner, packages 10,10' form a compact unit which is substantially planar on both sides, thereby making it an extremely efficient design for shipping, storage, and subsequent carrying by a consumer. A lens prescription comprising a right and left lens may thus be carried by the consumer as a single unit until ready for use, thereby reducing the chance of misplacing one of the lens packages needed for a single consumer prescription.

A second embodiment of the inventive package is shown in FIGS. 7–10 wherein each package 100,100' is substantially identical to packages 10,10' except that packages 100,100' each include six legs 102–107, 102'–107', respectively, which provide additional alignment means for attaching the packages together. Thus, packages 100,100' each include a support 110,110' having an elliptically shaped, planar top surface 112,112' and opposing bottom surface 114,114' with a downwardly curved skirt 116,116' encircling the periphery of the top surface 112,112', and a concave well 118,118' formed in top surface 112,112' with a raised, tear-shaped surface 120,120' encircling the periphery thereof.

Figure 7:
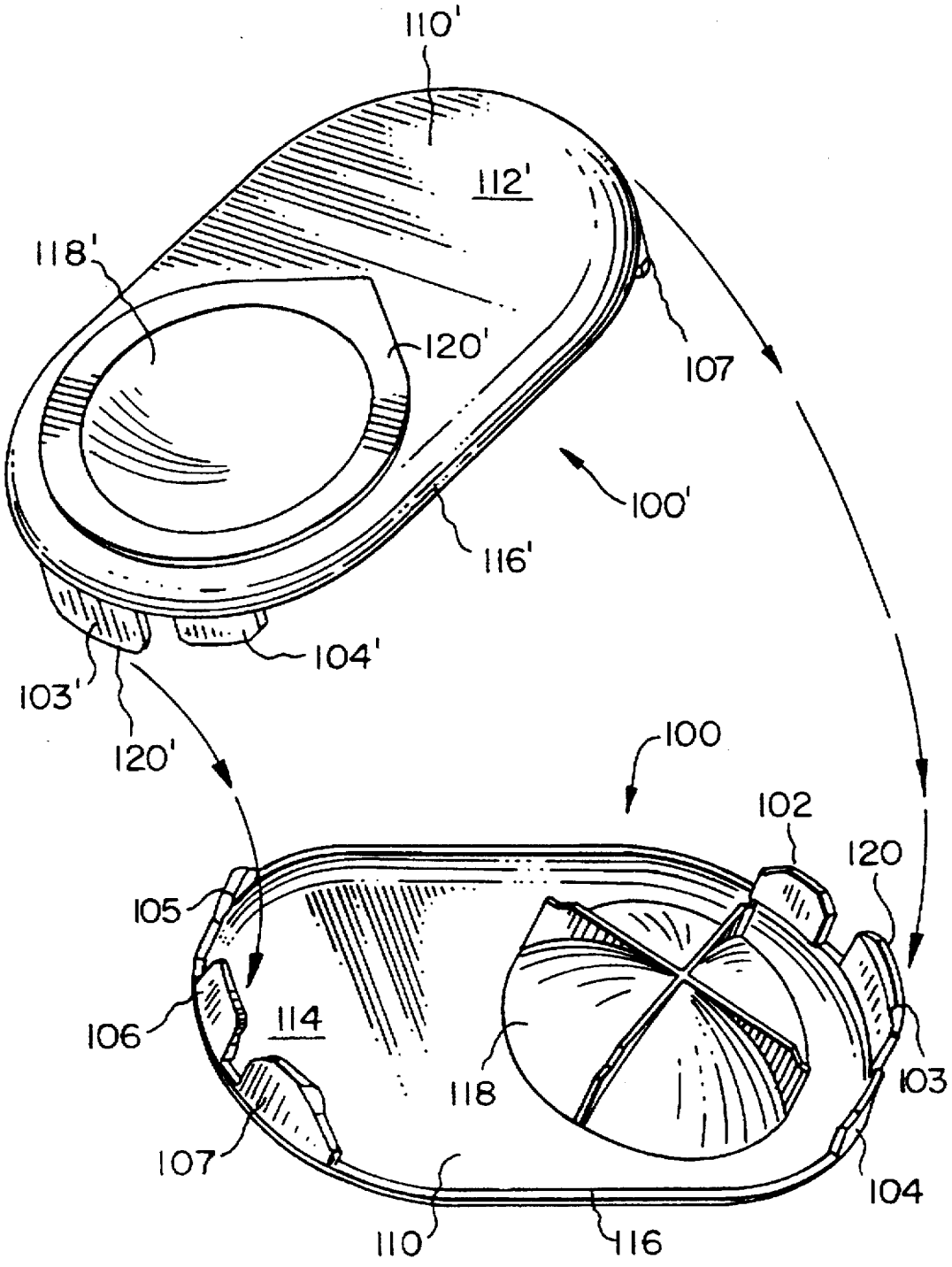
FIG. 7 is a perspective view of a pair of a second embodiment of the inventive contact lens packages shown spaced from one another prior to being attached together.
Figure 8:
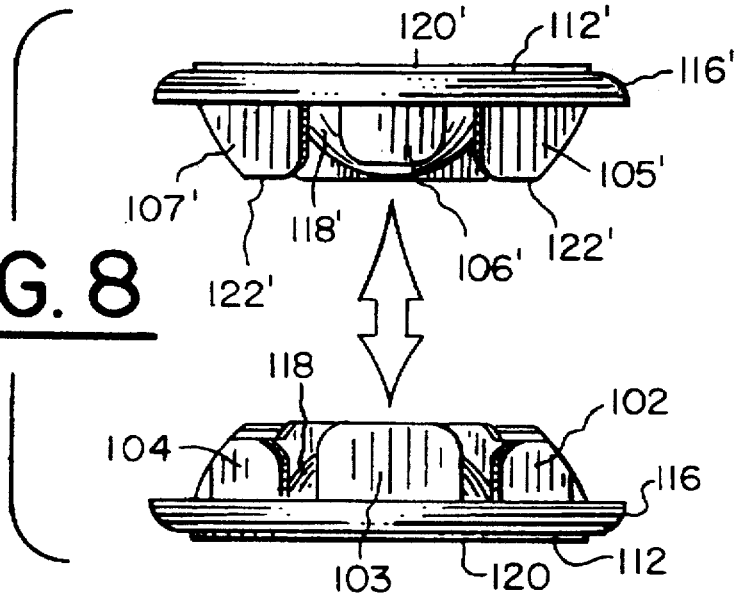
FIG. 8 is an end, elevational view of the packages of FIG. 7, one aligned above the other in spaced relation.
Figure 9:
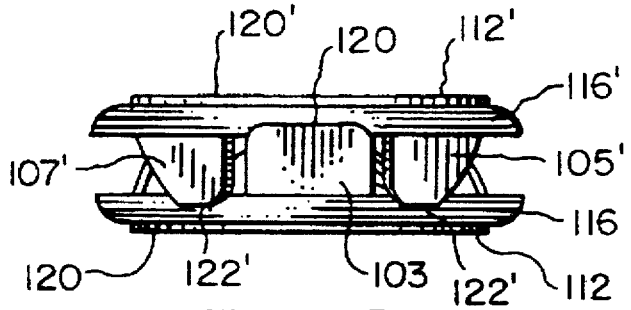
FIG. 9 is the view of FIG. 8 showing the packages attached together.
Figure 10:
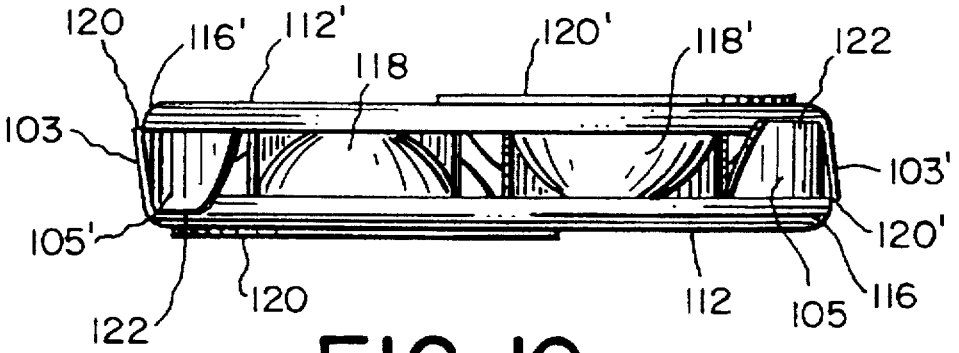
FIG. 10 is a side, elevational view of FIG. 9.

As seen best in FIG. 7, leg 103,103' located adjacent to well 118,118' is slightly wider and longer than legs 102,102' and 104,104' located on either side of and slightly spaced from center leg 103,103', respectively. Also, center leg 103,103' is spaced slightly outwardly of legs 102,102' and 104,104', respectively. Conversely, on the opposite end of top surface 112,112', center leg 106 is slightly shorter than legs 105,105' and 107,107' located on either side of and slightly spaced from center leg 106,106', respectively. Center leg 106,106' is approximately the same width as center leg 103,103'. The length of center leg 103,103' is approximately the same as the length of outer legs 105,105' and 107,107' located on the opposite end of top surface 112,112', and center leg 106,106' is approximately the same length as outer legs 102,102' and 104,104' located on the opposite end of top support 112,112'. As such, packages 100,100' may be brought together in the fashion shown in FIGS. 7 and 8 with one package 100 turned 180° relative to the second package 100', whereby the three legs 102, 103 and 104 of package 100 mesh with the three legs 105', 106' and 107' of package 100' and, on the opposite end of the packages, the three legs 105, 106 and 107 of package 100 mesh with the three legs 102', 103' and 104' of package 100', with center leg 103 of package 100 lying outwardly of shorter center leg 106' of package 100', and center leg 103' of package 100' lying outwardly of shorter center leg 106 of package 100. Additionally, legs 102, 104 of package 100 lie inwardly of legs 105', 107' of package 100', and legs 102', 104' of package 100' lie inwardly of legs 105, 107 of package 100, respectively (FIGS. 9 and 10).

As packages 100, 100' are brought together in the aligned fashion described and shown in FIGS. 7–10, leg 103 slides over shorter leg 106' and leg 103' slides over shorter leg 106 with the terminal ends 120,120' of the longer legs 103,103' frictionally engaging the skirt 116,116' of the opposite package, respectively. Likewise, longer legs 105 and 107 of package 100 slide over shorter legs 102' and 104' of package 100', respectively, and longer legs 105' and 107' of package 100' slide over shorter legs 102 and 104 of package 100, respectively, with the terminal ends 122,122' and 123,123' of the longer legs 105,105' and 107,107', respectively, frictionally engaging the skirt 116,116' of the opposite package. As with the first embodiment, the engaging legs 103,103', 105,105', and 107,107' of packages 100,100', respectively, are preferably made resiliently flexible to assist in the easy yet secure attachment and subsequent removal of the packages from each other.

It will be appreciated that the aforementioned inward spacing of the shorter legs 102,102', 104,104' and 106,106' result in the outwardly spaced legs 103,103', 105,105' and 107,107' sliding thereover as the packages 100,100' are brought together, respectively. These shorter legs thus act to facilitate manual alignment of the packages 100,100' as they are being attached together. It will further be appreciated that providing attachment means at both ends of the package provide for a very stable unit when two such packages are releasably attached together in the manner shown and described herein.

What is claimed is:

1. A disposable contact lens package comprising:

a) a rigid support having a top surface and a lens seating surface having a height "H" located on said top surface; and b) a plurality of legs attached to and extending downwardly from the perimeter of said top surface, each of said legs terminating into a free end spaced from said top surface, at least one of said legs including a catch formed at said free end thereof, said catch being operable to releasably, frictionally engage the top surface of a second package, substantially identical to said disposable contact lens package upon placing and pressing said packages together in stacked relation to one another with said top surfaces of each facing away from each other.

2. The package of claim 1 wherein said legs are formed integrally with said support.

3. The package of claim 1 wherein said legs which include said catch are resiliently flexible.

4. The package of claim 1 wherein said top surface includes a downwardly depending skirt extending about the full periphery of said top surface, said skirt having a height "h" which is less than half the corresponding height "H" of said lens seating surface, said legs attached to and depending from said skirt in a direction away from said top surface.

5. The package of claim 4 wherein said catch of said contact lens package releasably engages said skirt of the opposite package upon attaching two of said contact lens package together.

6. The package of claim 1, and further comprising catches formed at said free ends of each of said legs.

7. The package of claim 1 wherein said lens seating surface comprises a concave well.

8. The package of claim 1 wherein said top surface is elliptically shaped, and said lens seating surface is positioned in a location off-set from the center of said top surface.

9. The package of claim 8 wherein said package includes a bottom surface located opposite said top surface thereof, and wherein said contact lens package and said substantially identical package may be attached together with said bottom surfaces thereof facing each other, said packages being rotated 180° relative to each other in the attached condition such that said lens seating surface of each of said packages lie in adjacent relationship.

10. The package of claim 9 wherein said lens seating surface comprises a concave well.

11. The package of claim 1 wherein three legs are attached to said top surface, each of said three legs including a catch formed on said free end thereof.

12. The package of claim 11 wherein one of said legs is located adjacent said lens seating surface, and the other two of said legs are located in spaced relation to each other on the side of said top surface opposite said lens seating surface such that said one leg of each of said packages meshes with said two legs of the package opposite said one leg in said attached condition.

13. The package of claim 12, wherein said top surface includes a downwardly depending skirt extending about the full periphery of said top surface, said skirt having a height "h" which is less than half the corresponding height "H" of said lens seating surface, said legs attached to and depending from said skirt in a direction away from said top surface.

14. The package of claim 1 wherein the portion of said top surface surrounding said lens seating surface is raised relative to the remaining portion of said top surface.

15. The package of claim 14 and further comprising a cover removably sealed to said raised portion of said top surface over said lens seating surface.

16. The package of claim 15 wherein a portion of the periphery of said raised portion of said top surface forms an acute angle defining a point whereby said point facilitates in breaking the seal of said cover to said top surface upon removing said cover.

17. The package of claim 13 wherein the portion of said top surface surrounding said lens seating surface is raised relative to the remaining portion of said top surface.

18. The package of claim 17 and further comprising a cover removably sealed to said raised portion of said top surface over said lens seating surface.

19. The package of claim 18 wherein a portion of the periphery of said raised portion of said top surface forms an acute angle defining a point which facilitates in breaking the seal of said cover to said top surface upon removing said cover.

20. The package of claim 1 wherein said top surface is elliptically shaped, and said lens seating surface is positioned in a location off-set from the center of said top surface, and wherein six legs extend downwardly from the perimeter of said top surface.

21. The package of claim 20 wherein three of said legs are located in spaced relation adjacent said lens seating surface, and the other three of said six legs are located in spaced relation at the end of said support opposite said lens seating surface.

22. The package of claim 21 wherein three of said legs are longer than the other three of said legs, said longer legs each including a catch at said free ends thereof whereby said contact lens package may be attached to a second package substantially identical to said contact lens package with said catch on said longer legs of one package releasably, frictionally engaging said top surface of the other package.

23. The package of claim 22 wherein the shorter legs alternate with the longer legs at each end of said package.

24. The package of claim 23 wherein a longer leg is the middle leg of the three legs located adjacent the lens seating surface, and a shorter leg is the middle leg of the three legs located at the end of said support opposite said lens seating surface.

25. The package of claim 24 wherein the longer legs are spaced radially outwardly with respect to said shorter legs such that said longer legs overlap the shorter legs of the opposite package when said contact lens package and said second package are attached together with the bottom surfaces thereof facing each other and one package is turned 180° relative to the other package.

26. A method for releasably attaching two disposable contact lens packages together, said packages each including a support having a top surface with a lens seating surface located on said top surface, and a bottom surface located opposite said top surface, said method comprising the steps of:

a) providing a plurality of legs attached to said support of each of said contact lens packages, at least one of said legs including a catch formed at the free end thereof located opposite said support; and b) attaching said packages together with said top surfaces of each facing away from each other whereby said catch of one of said packages frictionally engages said top surface of the other of said packages thereby releasably attaching said two packages together, said legs being spaced such that the legs of one package mesh with the legs of the other package upon releasably attaching said two contact lens packages together.

27. The method of claim 26, and further comprising the step of rotating one package 180° relative to the other package when releasably attaching said two packages together.

28. The method of claim 27 wherein said support of each of said two packages is elliptically shaped.

29. The method of claim 28 wherein said lens seating surface comprises a concave well which is located in a position off-set from the center of said support, said wells of each of said two packages lying in adjacent relationship to each other when said two packages are attached together with said bottom surfaces of each facing each other.

* * * * *